US006499480B2

(12) United States Patent
Ashton et al.

(10) Patent No.: US 6,499,480 B2
(45) Date of Patent: Dec. 31, 2002

(54) HEATER WITH LIGHT

(75) Inventors: Jerald Ashton, Wichita, KS (US); Clyde Schulte, Wichita, KS (US); Randall L. May, Andover, KS (US)

(73) Assignee: The Coleman Company, Inc., Wichita, KS (US)

( * ) Notice: Subject to any disclaimer, the term of this patent is extended or adjusted under 35 U.S.C. 154(b) by 4 days.

(21) Appl. No.: 09/755,334

(22) Filed: Jan. 5, 2001

(65) Prior Publication Data

US 2002/0023636 A1 Feb. 28, 2002

Related U.S. Application Data

(63) Continuation-in-part of application No. 09/579,994, filed on May 26, 2000.

(51) Int. Cl.[7] ..... F21V 36/00; F21V 33/00

(52) U.S. Cl. ..... 126/92 B; 126/255; 431/100; 362/93; 362/179

(58) Field of Search ..... 126/92 R, 92 B, 126/92 AC, 259 R, 259 M, 255, 256, 257, 258, 260; 431/344, 278, 100, 109, 107; 362/93, 179, 180, 181, 182, 312, 253

(56) References Cited

U.S. PATENT DOCUMENTS 2,638,085 A * 5/1953 Guedon ..... 431/109
3,020,384 A 2/1962 Murphy et al.
3,063,278 A * 11/1962 Van Tubergen et al. .... 362/181

FOREIGN PATENT DOCUMENTS

JP 9-303784 A * 11/1997
WO WO98/58211 12/1998

* cited by examiner

*Primary Examiner*—Sara Clarke
(74) *Attorney, Agent, or Firm*—Kramer, Levin, Naftalis & Frankel LLP

(57) ABSTRACT

A heater provides both radiant heat and light. The heater provides radiant heat via a heater assembly which includes a gas burner heating a screen; the screen in turn provides radiant heat. The heater includes a light assembly which may provide light by, for example, burning gas fuel, or by other means such as electricity. The heater may include a heat reflector which can be removed and compacted or disassembled for storage. The light assembly may include easily removable glass panels surrounding the light source. Each glass panel is mounted to the lighting assembly by tabs extending from the bottom of the glass panel and a thumbscrew connection attaching the top portion of the glass panel to the lighting assembly. Hot exhaust gasses generated by the lighting assembly may escape through vents near the top of the lighting assembly, below the heating assembly.

16 Claims, 14 Drawing Sheets

HEATER WITH LIGHT

RELATED APPLICATIONS

The present application is a continuation-in-part of U.S. patent application Ser. No. 09/579,994, filed May 26, 2000, entitled "Heater With Light."

FIELD OF THE INVENTION

The present invention relates to gas fuel heaters. In particular, the present invention relates to a gas fuel heater providing both heat and light and having a compact reflector.

BACKGROUND INFORMATION

Conventional radiant gas fuel heaters provide heat by burning fuel such as propane or butane. An example of such a radiant heater is the 5045 Radiant Heater available from the Coleman Corporation.

Conventional gas fuel heater designs include a refillable and/or possibly a removable fuel storage tank, a fuel delivery apparatus, and a gas ring or burner plate for burning the gas. The fuel delivery apparatus provides an air/fuel mixture to the gas ring or burner plate, and may include a regulator and other equipment, such as an operator fuel flow controller. The regulator accepts fuel, such as gas, from a fuel source and provides a steady, controlled fuel stream of constant pressure as an output. The fuel source may be a removable, portable fuel storage tank, or may be a permanent supply line from another suitable fuel source.

The gas ring expels an air/fuel mixture in a ring shaped pattern, and the air/fuel mixture burns. A conical or cylindrical metal grid extends upwards from the area of the gas ring. As a result, the metal grid is heated, possibly to the point of glowing, and emits radiant heat, thereby providing radiant heat to objects (including people) nearby. In such a design a heat reflector typically sits above the metal grid, reflecting the heat provided by the grid downward and laterally. The heat reflector itself may be substantially heated and may emit radiant heat on its own. The portion of the heater holding the heated metal grid and heat reflector may be raised by a post to a height of, for example, six or seven feet above the ground, allowing heat to radiate downward and outward from a point above the level of users' heads.

The heat reflector in such a design includes a metal disk having a curved or concave shape. Such reflectors may be set-up and shipped as one set-up unit. If the gas heater is shipped partially disassembled (with, for example, the reflector removed) such a heat reflector takes up a relatively large amount of space in the shipping carton. Such a heat reflector may be, for example, three feet in diameter.

Conventional gas fuel heaters do not provide light and thus when used in the evening must be accompanied by a separate lighting source if lighting is desired. Various types of lighting apparatus exist. For example, a conventional gas burning lantern provides light to a user by burning gas at a burner tube covered with a mantle. Fuel may be provided to the burner tube by a fuel delivery apparatus, similar to the fuel delivery apparatus of the gas heater described above. As fuel passes through the fuel delivery path it mixes with air. The air/fuel mixture flows to the burner tube and mantle. When ignited with a air/fuel mixture provided by the fuel delivery apparatus, the mantle emits a bright light. The mantle in such a lantern contains a light emitting element, which converts the heat from the flame into light. Examples of conventional gas burning lanterns include adjustable gas lanterns manufactured by The Coleman Company of Wichita, Kans. Other types of lighting apparatus are well known—e.g., appliances that burn fuel such as kerosene, or which use electricity supplied by batteries or electric current from an electrical power outlet.

A lighting apparatus may include a clear covering, such as one or more glass panels, to shield a flame producing light from air currents, to direct exhaust gasses, or to prevent users from having access to burner components. It may be desirable to remove the covering to, for example, service or clean the lighting apparatus. In some lantern designs, such glass panels may not be removable, or may only be removable using tools.

The need for heaters and lighting apparatus is often co-extensive. Heat is often required at night. Often heat and light are required at the same time in places (such as back yards or patios) which may be inconvenient to heat via methods used indoors (e.g., central heat and electric light). However, the typical solution to such needs is to provide separate devices—e.g., a separate heating unit and a separate lighting unit. The use of separate units presents inefficiencies and takes up substantial space.

It would be desirable to have a gas fuel heater which includes a heat reflector which, when not in use or when being shipped, is relatively compact. It would be desirable to have a unit which provides both heat and adequate light. It would be desirable to have such a unit where the heat and light providing portions operate the the same fuel or power supply. It would be desirable to have such a unit where the heat and light providing portions do not interfere with each other's operation. It would be desirable to have a lighting unit having easy access to lighting components.

SUMMARY OF THE INVENTION

A heater according to a preferred embodiment of the present invention provides both radiant heat and light. The heater provides radiant heat via a heater assembly which includes a gas burner heating a screen; the screen in turn provides radiant heat. The heater also includes a light assembly which may provide light by, for example, burning gas fuel, or by other means such as electricity. The light assembly may include easily removable glass panels surrounding the light source. Each glass panel is preferably held on to the lighting assembly by tabs extending from the bottom of the glass panel and a thumbscrew connection attaching the glass panel to the top portion of the lighting assembly. Preferably, air for feeding lighting assembly combustion enters through openings near the bottom of the lighting assembly. Preferably, hot exhaust gasses generated by the lighting assembly escape through vents near the top of the lighting assembly, below the heating assembly. Preferably, the heater includes a heat reflector which may be removed and compacted or disassembled for storage.

DETAILED DESCRIPTION OF THE INVENTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details. Furthermore, well known features may be omitted or simplified in order not to obscure the present invention.

Figure 1:
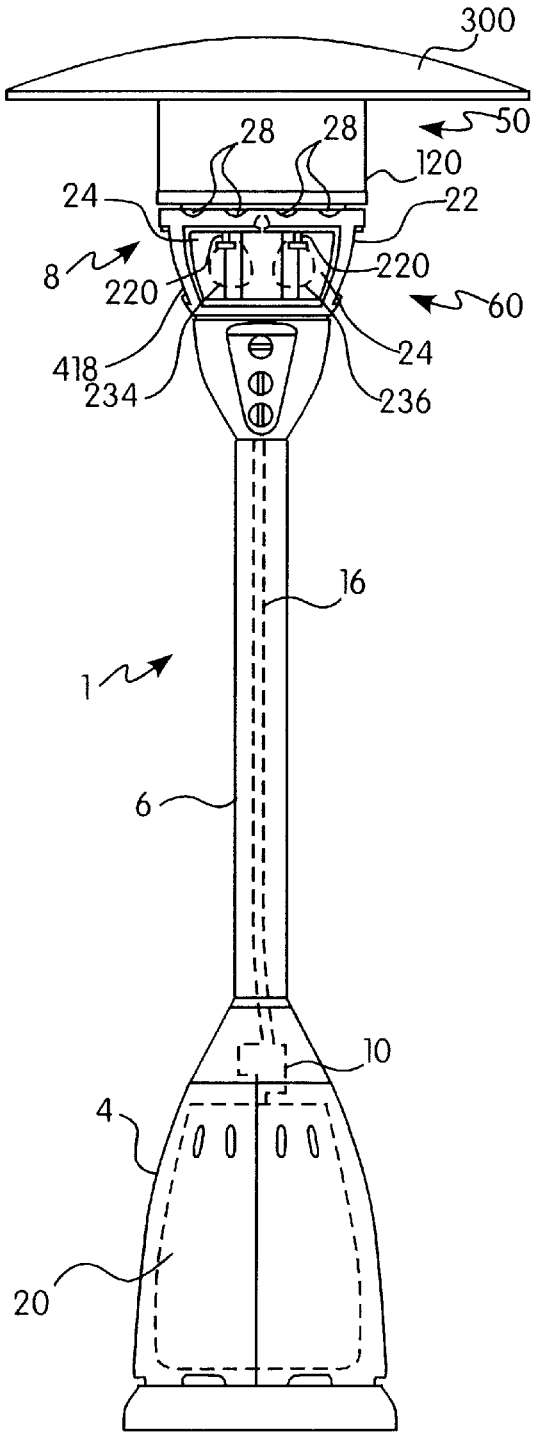
FIG. 1 illustrates a heater according to an exemplary embodiment of the present invention.

FIG. 1 illustrates a heater according to an exemplary embodiment of the present invention. Referring to FIG. 1, the heater 1 includes a base cabinet 4, a support pole 6, and a heat and light assembly 8. Preferably the heat and light assembly 8 includes a heating assembly 50 for selectively providing heat to a user and a lighting unit 60 for selectively providing light to a user. In a preferred embodiment, the heating assembly 50 includes a burner plate 118 (FIGS. 2 and 3) and cylindrical grid 120, for providing heat. The lighting unit 60 includes lantern burner tube 220 and two mantles 234 and 236, for providing light. Preferably a set of exhaust openings 28 allow gasses produced by the lighting unit 60 to exit the lighting unit 60 prior to reaching the heating assembly 50. A preferably removable and compressible or collapsible heat reflector 300 sits on top of the heat and light assembly 8 and reflects heat, and possibly light, downward and outward. The heat reflector 300 is, for example, approximately three feet in diameter. The heat and light assembly 8 is located at a height of approximately seven or eight feet; other dimensions may be selected. A frame or shell 418 surrounds the lantern burner tube 220 and mantles 234 and 236, and supports one or more glass panel units 24 to allow light to be emitted from the mantles. The glass panel units 24 preferably include heat resistant glass panels held in metal frames, but may be constructed of other suitable materials.

In a preferred embodiment, the heater 1 includes a regulator 10, which accepts a flow of fuel from a fuel tank 20, and which provides a controlled flow of fuel to the heating elements and to the lighting elements via a fuel hose 16, which extends through the support pole 6. The fuel may be, for example, combustible gas such as propane, or may be other fuels. The regulator 10 is preferably of known construction. In operation, fuel flows from the fuel tank 20 to the regulator 10. The regulator 10 accepts a variable pressure input of fuel from the fuel tank 20 and outputs a relatively constant fuel flow of relatively constant pressure to the fuel hose 16. A filter (not shown) may be located near the bottom of the regulator 10. The fuel delivery system, which may include, for example, the fuel tank 20, the regulator 10, the fuel hose 16, and various valves and hoses, may include other combinations of components. For example, fuel may be supplied directly from a permanently installed outside line.

The fuel tank 20 may be of known construction and connects to the regulator 10 through known methods. The fuel tank 20 is preferably removable, refillable, and replaceable. For example, the fuel tank 20 may be a removable twenty pound propane cylinder. The base cabinet 4 may include a door allowing access to the interior of the base cabinet 4 for fuel tank replacement. Alternately, an external fuel supply may be attached to the heater 1 at, for example, the regulator 10.

Figure 2:
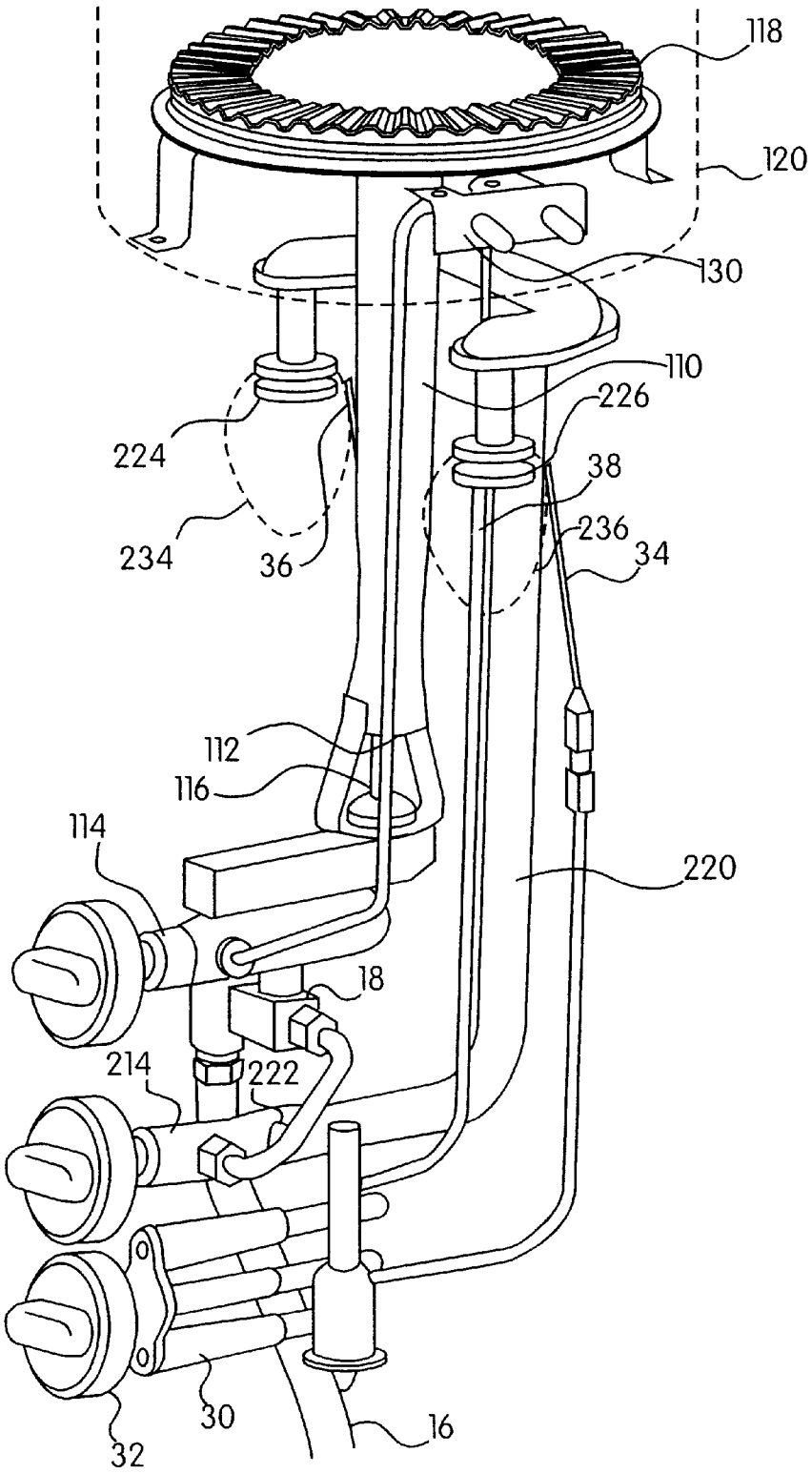
FIG. 2 illustrates the heat and light producing components of the embodiment of the heater of FIG. 1.
Figure 3:
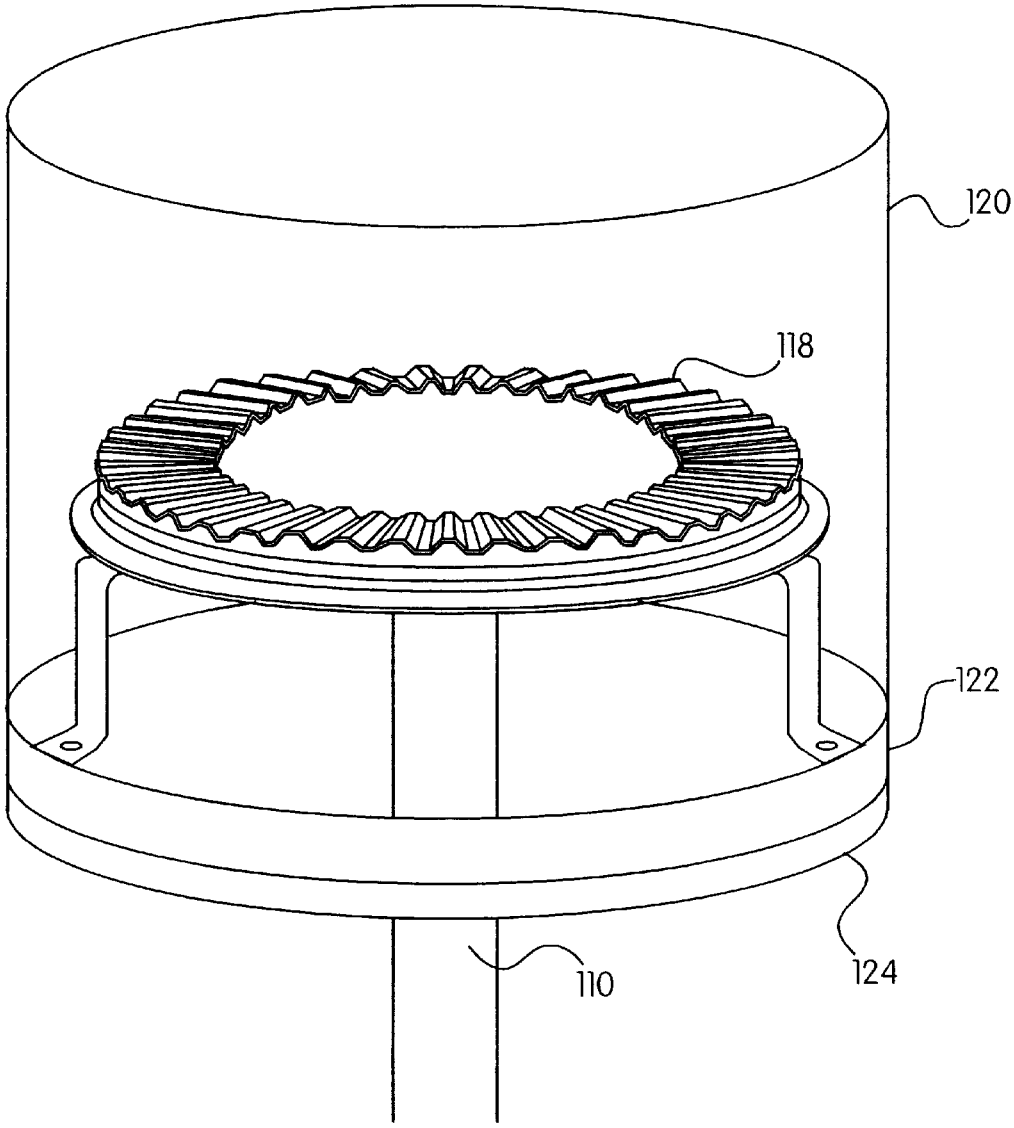
FIG. 3 illustrates a portion of the heat producing components of the embodiment of the heater of FIG. 1.

The individual heating and lighting components of the heater according to the present invention may be of known construction. FIG. 2 illustrates the heat and light producing components of the embodiment of the heater of FIG. 1. FIG. 3 illustrates a portion of the heat producing components of the embodiment of the heater of FIG. 1.

Referring to FIGS. 2 and 3, the fuel hose 16 supplies fuel to a T-valve 18. The T-valve 18 supplies the fuel to a heater valve 114 which supplies fuel to heater components, and to a light valve 214 which supplies fuel to lighting components. The heater valve 114 supplies fuel to, for example, a heater burner tube 110, which supplies an air/fuel mixture to the burner plate 118, and to a pilot light 130, which lights the burner plate 118. The heater burner tube 110 has an opening 112 near its bottom for accepting fuel and ambient air. A cylindrical grid 120 extends upwards from the area of the burner plate 118. A burner plate base 122 (FIG. 3), providing heat shielding, and supporting the grid 120, and a heat shield 124 (FIG. 3), shielding components of the heating assembly 50 from the heat generated by the lighting unit 60, lie beneath the burner plate 118.

In a preferred embodiment, the grid 120 is of known construction, and is, for example, a cylindrical grid or mesh approximately one foot high and approximately fourteen inches in diameter. The burner plate 118 is also of known construction and may be approximately six to eight inches in diameter. Alternately, the grid may be of other shapes, such as conical. Other radiant heat producing devices may be used. Preferably, the burner plate 118 is constructed from stainless steel and the grid 120 is preferably constructed from stainless steel; however, other suitable materials may be used.

In operation, fuel exits the heater valve 114 via a fuel jet 116 and enters the opening 112 in the burner tube 110; air is also drawn in to the opening 112. The air and fuel travel up the heater burner tube 110, mix in the burner tube 110, and exit at the burner plate 118. The air/fuel mixture expelled by the burner plate 118 burns, and the flames extend, for example, outward and upward from the burner plate 118 and thereby heating the grid 120. The grid 120 is heated, possibly to the point of glowing, and emits radiant heat, providing radiant heat to objects (including people) nearby. Some of the radiant heat is reflected outward and downward by the heat reflector 300 (FIG. 1). The heat reflector 300 itself may be substantially heated (to, for example, 600 degrees Fahrenheit) and may emit radiant heat of its own.

In a preferred embodiment, when shipped to a user, the heater 1 may be partially disassembled to reduce shipping volume and thus shipping costs. Preferably, the heat reflector 300 is removable, and may be shipped in the same carton as the rest of the heater 1, or may be shipped in a separate carton. Furthermore, the heat reflector 300 is partially collapsible to further reduce the space it takes up in any shipping carton. For example, preferably, the heat reflector 300 may be disassembled, folded or otherwise compacted for shipping.

In an exemplary embodiment, the light valve 214 supplies fuel to the lantern burner tube 220. The lantern burner tube 220 has one or more air holes 222 allowing air to enter the lantern burner tube 220 and to mix with the fuel. The air/fuel mixture flows up the lantern burner tube 220 and flows to two mantle holders 224 and 226, to which are attached two mantles 234 and 236. The air/fuel mixture is combusted at the mantles 234 and 236. Each mantle 234 and 236 then glows to provide light. The mantles 234 and 236 are implemented in a known way, such as a fabric impregnated with a light emitting element, such as a catalyst. Such mantles are available from The Coleman Company of Wichita, Kans. The mantles 234 and 236 are attached to the mantle holders 224 and 226 in a known way. For example, a mantle may be tied to a mantle holder with thread.

In one embodiment, a piezoelectric lighter 30 of known construction can be included in the heating and lighting components and provides a spark to the pilot light 130 and each of the mantles 234 and 236. For example, turning the knob 32 of the lighter 30 causes a hammer inside the lighter 30 to strike a crystal inside the lighter 30; the crystal provides current to each of the electrodes 34, 36 and 38, which provide a spark, through known methods. Preferably, the lighter 30 provides electric current to all of the electrodes 34, 36 and 38 simultaneously; in alternate embodiments different electrodes may provide current to different portions of the apparatus at different times.

To cause the heater 1 to provide heat, a user turns the heater valve 114 to supply fuel to the pilot light 130. The user then turns the knob 32 of the lighter 30, to provide electric current to the electrode 38. The sparks provided by the electrode 38 ignite the fuel flowing out of the pilot light 130. The user then turns the heater valve 114 to allow fuel to flow to the burner plate 118. The air/fuel mixture flowing out of the burner plate 118 is ignited by the pilot light 130. The heater 1 may also include well known features such as a mechanism preventing burner lighting if the pilot light is not also lit.

To cause the heater 1 to provide light, a user opens the light valve 214 to supply fuel to the lantern burner tube 220, in turn causing an air/fuel mixture to flow to the mantles 234 and 236. The user then turns the knob 32 of the lighter 30, to provide electric current to the electrodes 34 and 36. The sparks provided by the electrodes 34 and 36 ignite the fuel flowing to the mantles 234 and 236, heating the mantles 234 and 236 and causing the mantles 234 and 236 to glow.

The heater according to an embodiment of the present invention provides more flexible use and operation in that it may provide heat, light, or both to a user. By providing two fuel control valves the user may control the heat and light source separately. The heat and light providing elements may be powered by the same fuel source (e.g., a gas canister). Thus, separate heating and lighting units are not needed. Furthermore, the heat and light are provided from the same location.

An embodiment of the present invention includes a venting mechanism allowing hot exhaust gasses generated by the lighting unit 60 to escape prior to reaching the heating assembly 50. Such a mechanism prevents the lighting unit 60 from interfering with the heating assembly 50, and thus facilitates the combination of the heating unit 50 with the lighting unit 60. Referring to FIG. 1, preferably, during operation, air enters the heater 1 through external openings, then flows to the lighting unit 60 through openings located below the lighting unit 60. The air may take part in combustion at the mantles 234 and 236, or, if not used in combustion, be heated by the combustion. The flames at the mantles 234 and 236 produce hot exhaust gasses. The heated air and exhaust gasses exit the lighting unit 60 prior to reaching the heating assembly 50, preferably via a set of exhaust openings 28, preventing excessive heating of the heating assembly 50 and preventing combustion products produced by the lighting unit 60 from interfering with the operation of the heating assembly 50. The removal of combustion gasses from the lighting unit 60 allows the lighting unit 60 to function more efficiently. The heat shield 124 (FIG. 3) and burner plate base 122 (FIG. 3) further shield components of the heating assembly 50 from the heat and combustion products generated by the lighting unit 60.

Preferably each glass panel unit 24 is removable for quick, easy access to the lighting unit 60. Preferably, each glass panel unit 24 is secured to the heater 1 by a set of tabs (FIGS. 15*a* and 15*b*) extending from the lower portion of the glass panel unit 24 and a thumbscrew (FIGS. 15*a* and 15*b*) located on the upper portion of the glass panel unit 24. In the event that a glass panel unit 24 is to be removed or replaced, a user manually operates the thumbscrew and removes the glass panel without the aid of a tool such as a screwdriver or wrench. While a glass panel unit 24 is removed, a user may, for example, replace one of the mantles 234 and 236 or clean components of the lighting unit 60.

Figure 11:
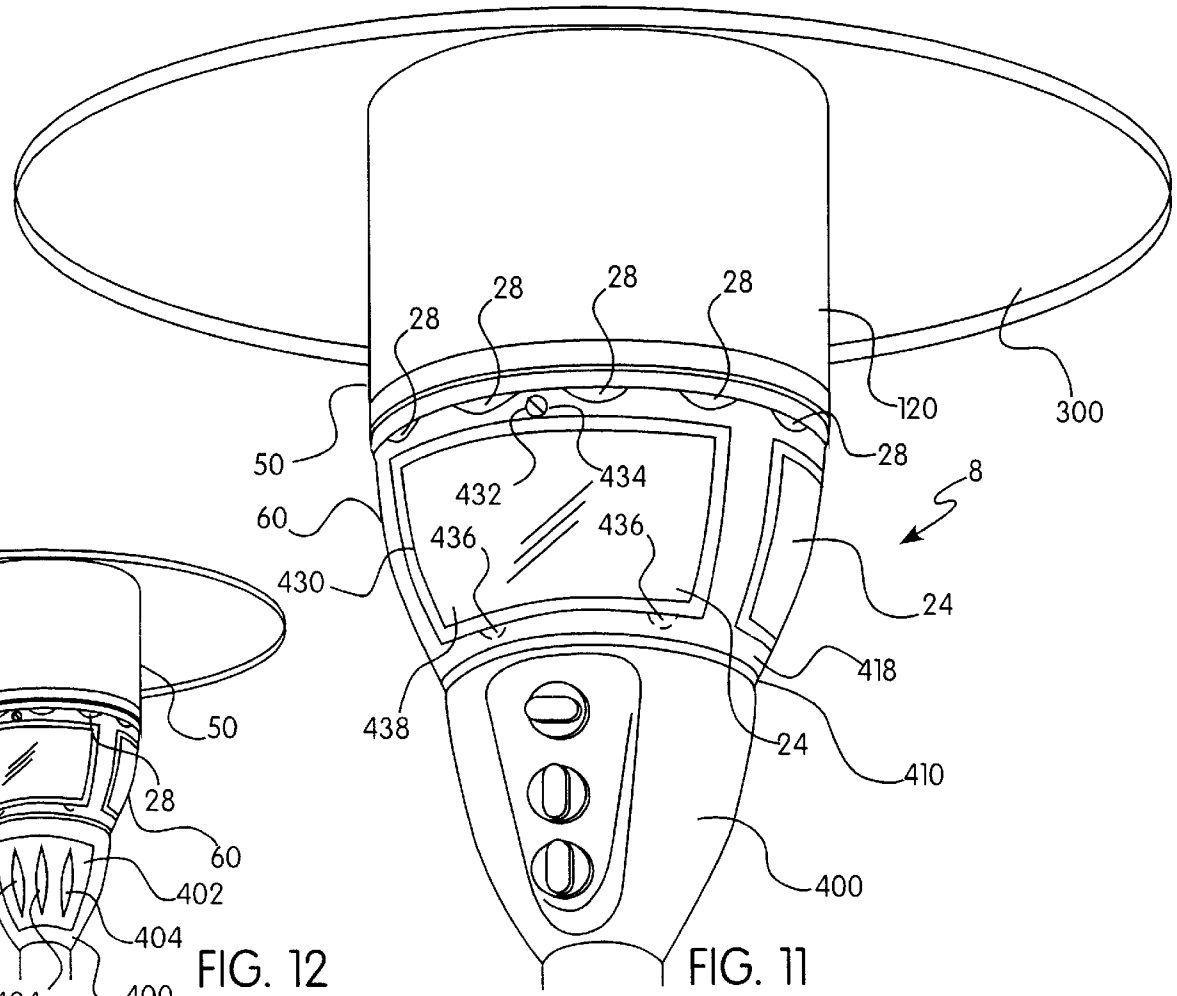
FIG. 11 illustrates the heat and light assembly and the control unit of the embodiment of the heater of FIG. 1.
Figure 12:
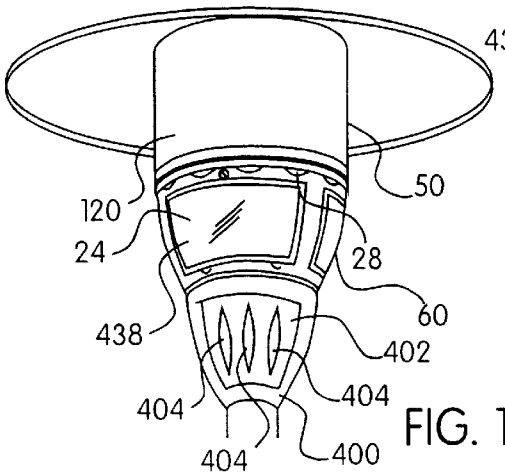
FIG. 12 illustrates the heat and light assembly and the control unit of the embodiment of the heater of FIG. 1, as seen from the rear.

FIG. 11 illustrates the heat and light assembly and the control unit of the embodiment of the heater of FIG. 1. FIG. 12 illustrates the heat and light assembly and the control unit of the embodiment of the heater of FIG. 1, as seen from the rear. Referring to FIGS. 11 and 12, the lighting unit 60 includes a shell 418 holding a plurality of glass panel units 24. A preferably removable access door 402 allows access to the components of the control unit 400. During operation, air enters the heat and light assembly 8 through slits 404 located on access door 402. Preferably the slits 404 include three oblong slits; other numbers of openings, having different shapes, may be used. Preferably the access door 402 is easily removable and is secured to the control unit 400 by, for example, a set of tabs and a thumbscrew.

In alternate embodiments, openings allowing gasses to enter and leave the lighting unit 60 and venting gasses and heat from the lighting unit 60 prior to such gasses and heat reaching the heating unit may be located in different portions of the heater 1 and may be of different configurations. For example, openings allowing air into the heater 1 may not be located on the access door 402.

Figure 13:
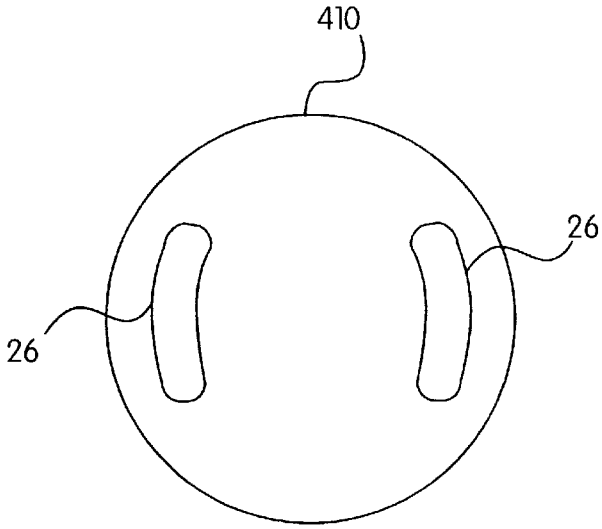
FIG. 13 illustrates the plate separating the lighting unit and the control unit of the embodiment of the heater of FIG. 1.

The control unit 400 is preferably separated from the lighting unit 60 by a plate 410; preferably the plate 410 is integral with the shell 418 of the lighting unit 60. FIG. 13 illustrates the plate separating the lighting unit and the control unit of the embodiment of the heater of FIG. 1. Referring to FIG. 13, the plate 410 includes air openings 26. Preferably the air openings 26 include two slits; other numbers of openings, having different shapes, may be used. Preferably, during operation, air entering the heater 1 through the slits 404 (FIG. 12) rises through the control unit 400 and enters the lighting unit 60 via the air openings 26. Hot air and exhaust gasses exit the lighting unit 60 via a set of exhaust openings 28, which in an exemplary embodiment are fluted or scalloped openings located along the upper rim of lighting unit 60, just below the heating assembly 50. Preferably the exhaust openings 28 extend completely around the upper circumference of the shell 418. In alternate embodiments the exhaust openings 28 may be of a different shape, arrangement or number.

Figure 14:
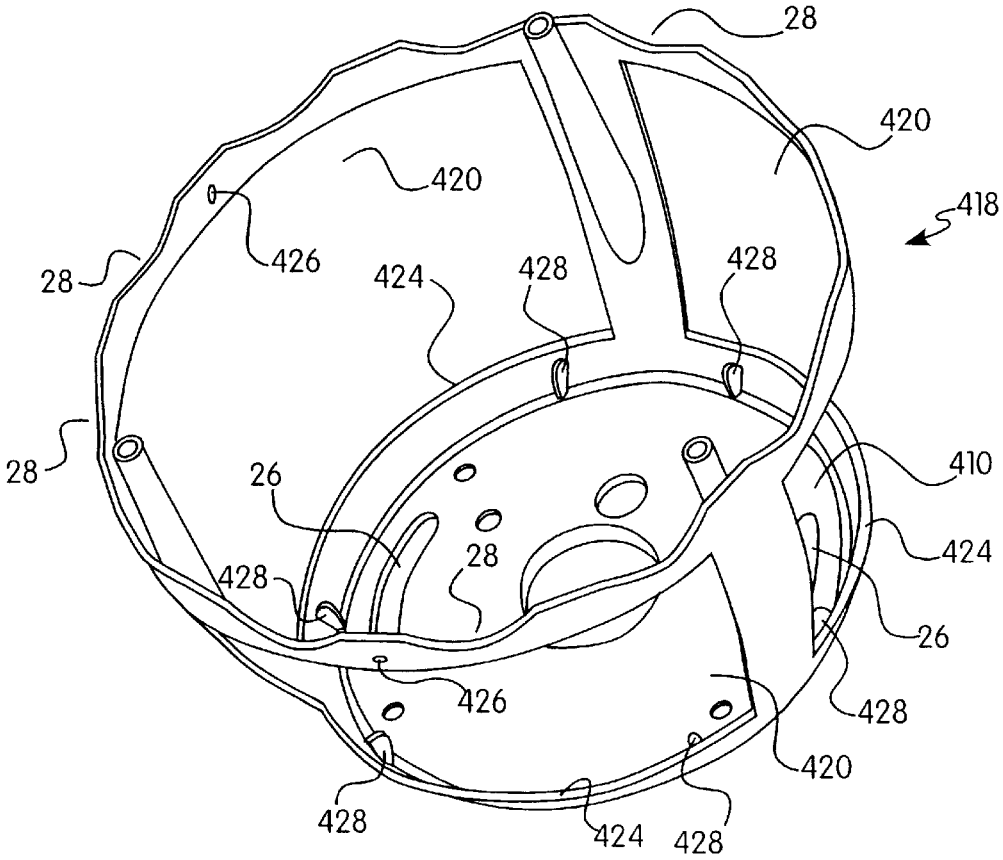
FIG. 14 illustrates the outer shell of the lighting unit of the embodiment of the heater of FIG. 1.

FIG. 14 illustrates the outer shell of the lighting unit of the embodiment of the heater of FIG. 1. Referring to FIG. 14, the shell 418 provides a frame for the lighting unit 60 and surrounds, protects and supports the components of the lighting unit 60. The shell 418 includes glass panel openings 420, each including a lower edge 424, for supporting glass panel units 24 (FIGS. 15*a*, 15*b*; globe mounts 428, for receiving and supporting window frame tabs 436 (FIGS. 15*a*, 15*b* and 16); and fastener holes 426, for securing glass panel units 24 to the shell 418 via a fastener such as a thumbscrew. The shell 418 includes the plate 410, which includes air openings 26. The shell 418 includes exhaust openings 28 for allowing hot exhaust gasses and hot air to escape from the lighting unit 60. Each lower edge 424 may be a ledge or shelf or may simply be a cut edge of the material forming the shell 418. The globe mounts 428 are tab supports supporting and holding the window frame tabs 436.

Figure 15A:
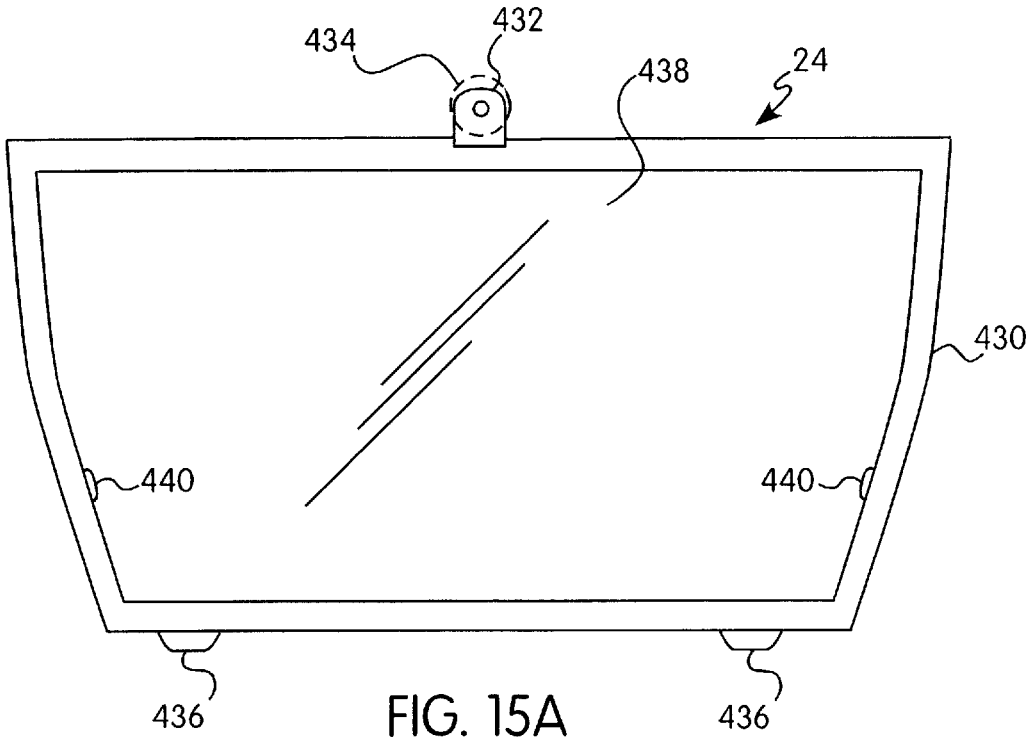
FIG. 15*a* is a front elevation view illustrating a glass panel unit of the lighting unit of the embodiment of the heater of FIG. 1.
Figure 15B:
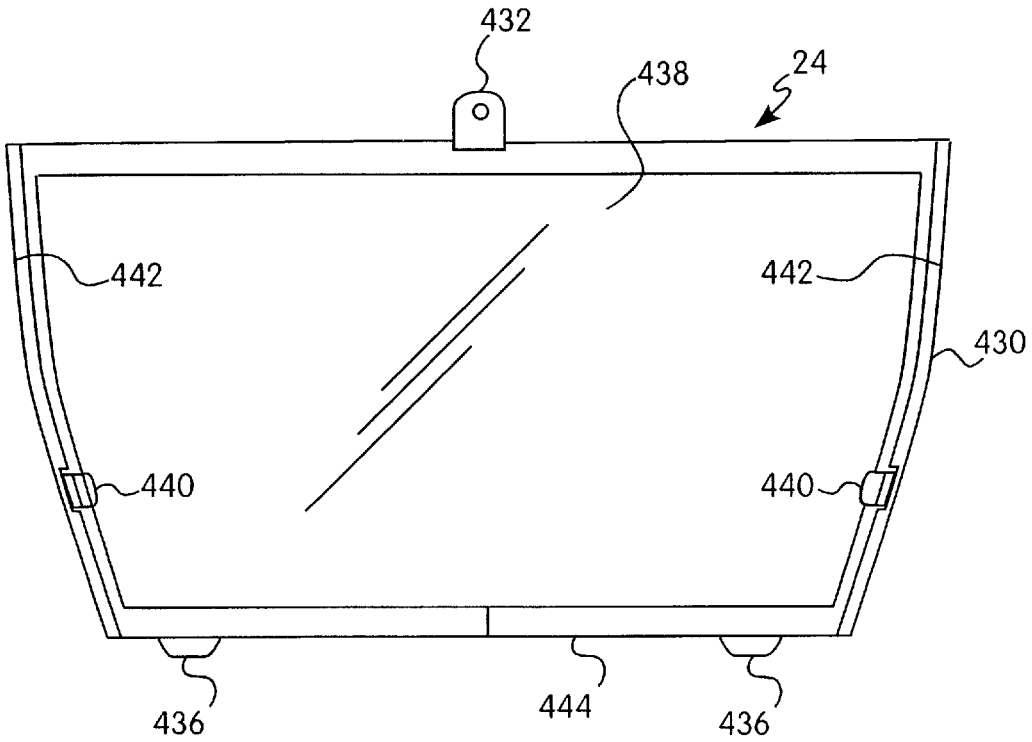
FIG. 15*b* is a rear elevation view illustrating a glass panel unit of the lighting unit of the embodiment of the heater of FIG. 1.

FIG. 15*a* is a front elevation view illustrating a glass panel unit of the lighting unit of the embodiment of the heater of FIG. 1. FIG. 15*b* is a rear elevation view illustrating a glass panel unit of the lighting unit of the embodiment of the heater of FIG. 1. Referring to FIGS. 15*a* and 15*b*, each glass panel unit 24 includes a frame 430 holding a heat resistant glass panel 438; frame rims 442 and preferably two glass panel tabs 440, for holding the glass panel 438 in the frame 430; a screw connector 432, for securing the glass panel unit 24 to the heater 1; and preferably two window frame tabs 436, for helping to secure the glass panel unit 24 to the heater 1. Preferably a lower shelf 444 extends from the rear of the frame 430 to aid in securing the glass panel 438 to the frame 430. Other numbers of window frame tabs 436 or glass panel tabs 440 may be used, and a different arrangement for securing the glass panel 438 to the frame 430 may be used. Preferably the frame rims 442 provide a slot for loosely holding the glass panel 438 in the frame 430 and the glass panel rests on the lower shelf 444. The glass panel tabs 440 are bent inward during manufacturing to further hold the glass panel 438 in the frame 430.

Preferably a thumbscrew 434 (shown in phantom in FIG. 15*a*, and not shown in FIG. 15*b*), for securing the screw connector 432 to the heater 1 via the fastener hole 426, may be inserted in the screw connector 432. While preferably the thumbscrew 434 may be removed from the screw connector 432, the thumbscrew 434 may be rotatably fixed to the screw connector 432 via, for example, a stop or a keep nut. Preferably the thumbscrew 434 is a hand operated screw of known construction which may easily be operated by a user without tools such as a screwdriver. In alternate embodiments another type of fastener may extend through the screw connector 432; for example a tool operated screw, a latch, or the like. Preferably, the heater 1 includes three glass panel units 24; other numbers of glass panel units 24 may be used.

Figure 16:
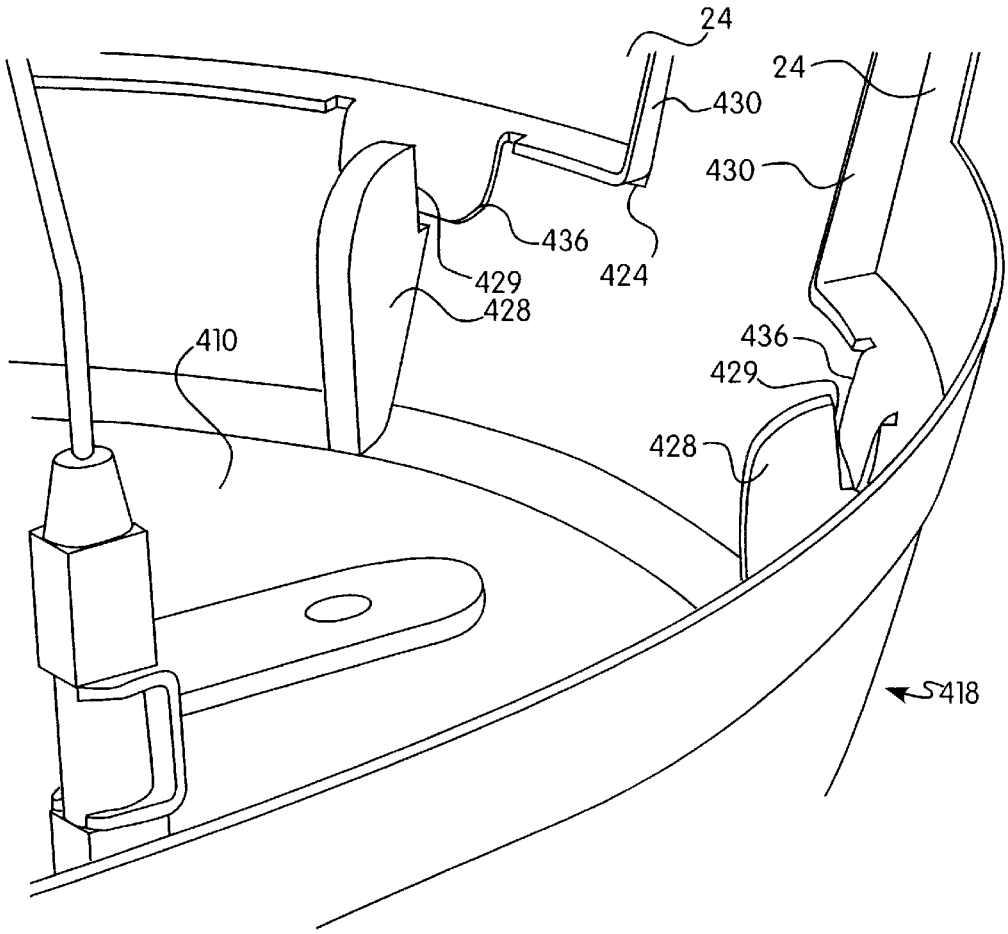
FIG. 16 is a partial cutaway view of the lighting unit of the embodiment of the heater of FIG. 1.

FIG. 16 is a partial cutaway view of the lighting unit of the embodiment of the heater of FIG. 1. Referring to FIG. 16, when a glass panel unit 24 is secured to the shell 418, the lower portion of the glass panel unit 24 rests on a corresponding lower edge 424 of the shell 418, and each of the window frame tabs 436 is seated against a corresponding globe mount 428. Each globe mount 428 includes a notch 429 for holding a window frame tab 436.

In one embodiment, on each glass panel unit 24, the screw connector 432 and window frame tabs 436 are integral with the frame 430. When mounted on the heater 1, each glass panel unit 24 is held in place by two tabs 436 and a thumbscrew 434. To secure a glass panel unit 24 to the heater 1, a user seats the glass panel unit 24 on a corresponding lower edge 424 of the shell 418. Referring to FIG. 16, the window frame tabs 436 are inserted into the space between the inside of the shell 418 and a notch 429 of a globe mount 428. Each window frame tab 436 rests in such a corresponding space, and helps keep the corresponding glass panel unit 24 in the shell 418. The user operates the thumbscrew 434 so that the thumbscrew 434 enters a fastener hole 426, securing the screw connector 432 to the heater 1. To remove a glass panel unit 24, the user operates the thumbscrew 434 so that the thumbscrew 434 is removed from the corresponding fastener hole 426, tilts the glass panel unit 24 outward, and unseats each window frame tab 436 from a corresponding globe mount 428. The glass panel units 24 of the lighting unit 60 are easily and quickly removable, without the use of any tools. In alternate embodiments the window frame tabs 436 may extend from other portions of the window frames 430, for example the sides, and further may mate with the shell 418 in different manners. Preferably the shell 418 and the window frames 430 are made of heat resistant material such as metal, e.g. steel or aluminum. Preferably each of the shell 418 and the window frames 430 are formed from one integral piece of material.

In alternate embodiments the heating assembly 50 and/or the lighting unit 60 may be powered by other power sources. For example, an electric lighting unit may be combined with a gas powered heating assembly. In such a lighting unit power may come from batteries or from a home A/C line, and light may be provided by an electric bulb, for example a fluorescent bulb. In alternate embodiments, different arrangements of valves, controls or lightning devices may be used. For example, one valve may be used for both the heating and lighting elements, or valves may be integral with a regulator.

In certain embodiments of the present invention, the heater 1 may include a heat reflector which may be shipped in a disassembled, folded or otherwise compacted manner to enable easier and more efficient shipping. In one embodiment, the heat reflector is circular or polygonal and includes a set of panels, each panel forming a section of the heat reflector. Preferably, each panel is a curved member having three sides: one outer side, forming the circular outside of the heat reflector; and two inner sides, corresponding to radii of the heat reflector.

Each inner side of a heat reflector panel includes, for example, a downward extension. Each downward extension mates with a downward extension of a neighboring panel to connect the panels. For example, the downward extensions may connect using friction fit tabs such as friction fit spring fasteners provided by the Tinnerman Company, or may connect using other suitable connectors. Each downward extension may include a shaped portion which corresponds to a shaped portion on a neighboring downward extension. Each panel also may include a shaped or cutout portion at the area where the two downward extensions join, in order to form a mounting hole near the center of the fully set-up heat reflector, so that the heat reflector may be mounted on the heater.

Figure 4A:
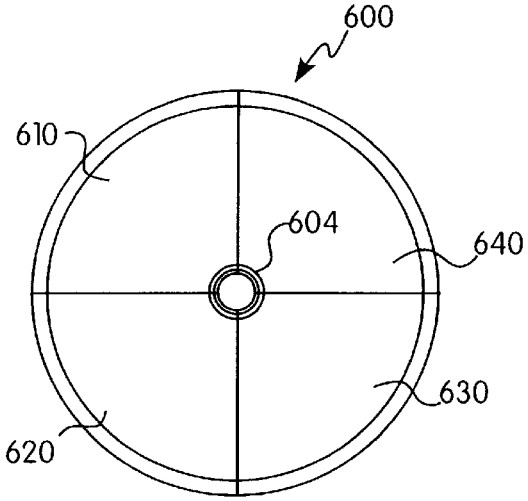
FIG. 4*a* illustrates a heat reflector of a heater according to an embodiment of the present invention.

FIG. 4*a* illustrates a heat reflector of a heater according to an embodiment of the present invention. Referring to FIG. 4*a,* the heat reflector 600 includes four panels 610, 620, 630 and 640, and a mounting hole 604, which may be used to attach the heat reflector 600 to a heater. other numbers of panels may be used. When assembled, the heat reflector 600 may be mounted to a heater by fitting the hole 604 over an extension on the top of the heater; the extension may attach to the heat reflector 600 by friction fit, by being screwed on, or by other methods.

Figure 4B:
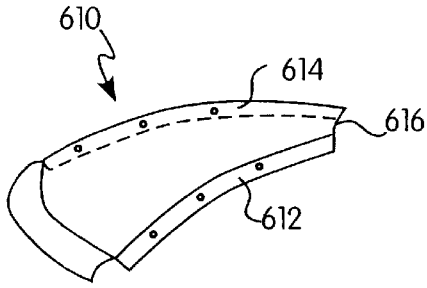
FIG. 4*b* illustrates a panel of the heat reflector of FIG. 4*a*.

FIG. 4*b* illustrates a panel of the heat reflector of FIG. 4*a.* Referring to FIG. 4*b,* panel 610 includes downward extensions 612 and 614, and includes a shaped or cutout portion 616. Similarly, panels 620, 630 and 640 each include downward extensions 612 and 614 and cutout portion 616. The panels 610, 620, 630 and 640 may stack one on top of another in a compact manner. FIG. 4*c* illustrates the panels of the heat reflector of FIG. 4*a,* disassembled and stacked. FIG. 4*d* illustrates the heat reflector of FIG. 4*a,* substantially set-up. In the depiction of FIG. 4*d,* one panel 610 is removed. The heat reflector 600 is preferably constructed from aluminum, but may be constructed from other materials, such as steel.

Figure 4G:
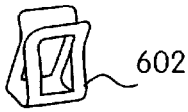
FIG. 4*g* illustrates a fastener of the heat reflector of FIG. 4*a.*
Figure 4C:
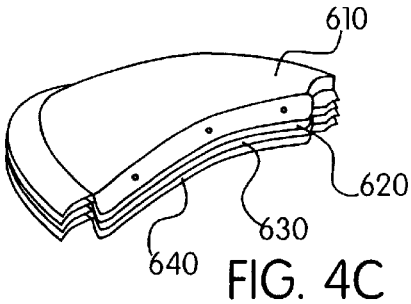
FIG. 4*c* illustrates the panels of the heat reflector of FIG. 4*a,* disassembled and stacked.
Figure 4E:
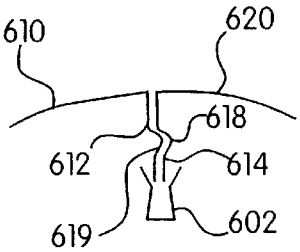
FIG. 4*e* illustrates portions of two heat reflector panels of the heat reflector of FIG. 4*a.*
Figure 4F:
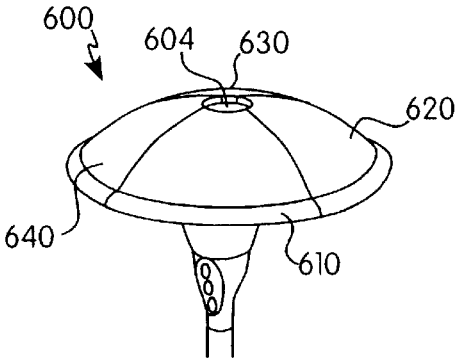
FIG. 4*f* illustrates the heat reflector of FIG. 4*a,* set-up and mounted to a heater.
Figure 4D:
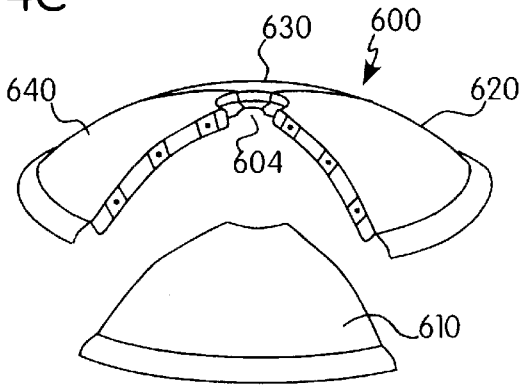
FIG. 4*d* illustrates the heat reflector of FIG. 4*a,* substantially set-up.

FIG. 4*e* illustrates portions of two heat reflector panels of the heat reflector of FIG. 4*a.* FIG. 4*g* illustrates a fastener of the heat reflector of FIG. 4*a.* Referring to FIGS. 4*e* and 4*g,* the downward extension 612 of the panel 610 is joined to the downward extension 610 of the panel 620 by, for example, a Tinnerman type fastener 602. The fastener 602 slides up over the downward extensions 610 and 612, and fits to the downward extensions 610 and 612 via a friction fit. Preferably, each adjacent panel 602 is connected by a plurality of such fasteners, for example three, connecting the downward extensions 610 and 612. Preferably, each downward extension includes grooves or indentations, such as indentations 618 and 619. Adjacent grooves or indentations 618 and 619 mate to enable easier connection of adjacent panels. FIG. 4*f* illustrates the heat reflector of FIG. 4*a,* set-up and mounted to a heater.

In a further embodiment, the heat reflector includes a set of panels, each panel hinged to the outside edge of a disk holder. The panels also may fold inward for storage, considerably reducing the surface area and storage area for the heat reflector. The panels may fold outward to expand the heat reflector to its operational size, in the manner of an opening flower or a common kitchen steamer. The heat reflector is then attached to the heater by attaching the disk to the heater.

Figure 5C:
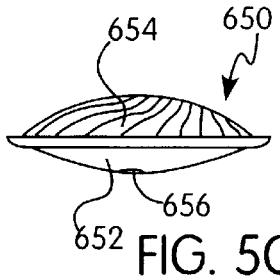
FIG. 5*c* illustrates the heat reflector of FIG. 5*a,* where the panels are folded inward for storage.
Figure 5B:
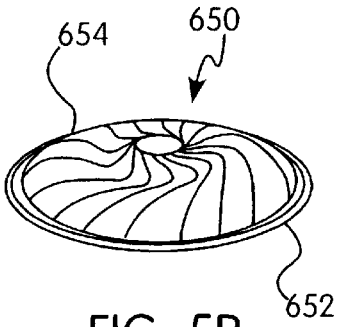
FIG. 5*b* illustrates the heat reflector of FIG. 5*a,* where the panels are folded inward for storage.
Figure 5A:
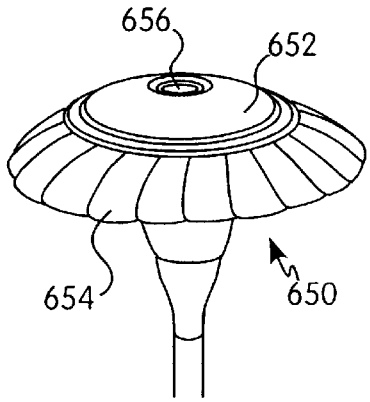
FIG. 5*a* illustrates a heat reflector of a heater according to another embodiment of the present invention, mounted to a heater.

FIG. 5*a* illustrates a heat reflector of a heater according to another embodiment of the present invention, mounted to a heater. Referring to FIG. 5*a,* the heat reflector 650 includes, for example, a preferably convex disk 652, to which are hingedly attached a plurality of panels 654. The disk 652 includes a cutout portion 656, by which the heat reflector 650 may be mounted to the heater. Each of panels 654 is preferably a quadrilateral panel which is curved to follow the shape of the disk 652. In alternate embodiments, the curve of the disk 652 or panels 654 may be different, or the disk 652 or the panels 654 need not be curved.

Figure 5D:
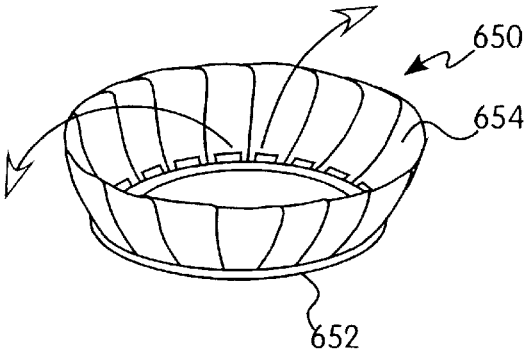
FIG. 5*d* illustrates the heat reflector of FIG. 5*a,* as the panels of the heat reflector are being folded outward.
Figure 5E:
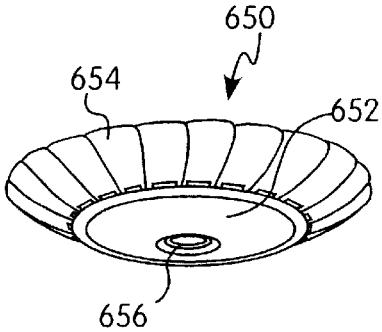
FIG. 5*e* illustrates the heat reflector of FIG. 5*a,* where the panels of the heat reflector are folded outward.

FIGS. 5*b* and 5*c* illustrate the heat reflector of FIG. 5*a,* where the panels are folded inward for storage. The panels 654 pivot on the disk 652 to fold inward to form a compact saucer shaped body. If the panels 654 and disk 652 are of different shapes, for example flat, the shape of the heat reflector 650 when folded is also different. FIG. 5*d* illustrates the heat reflector of FIG. 5*a,* as the panels of the heat reflector are being folded outward. FIG. 5*e* illustrates the heat reflector of FIG. 5*a,* where the panels of the heat reflector are folded outward. When the panels 654 open, the heat reflector 650 is inverted for mounting on the heater. The heat reflector 650 may be mounted to a heater by fitting the hole 656 over an extension on the top of the heater; the extension may attach to the heat reflector 650 by friction fit, by being screwed on, or by other methods. The heat reflector 650 is preferably constructed from aluminum, but may be constructed from other materials, such as steel.

In a further embodiment, the heat reflector includes a set of panels, each panel forming a section of the heat reflector, where the edges of adjacent panels slide over each other. Preferably, the heat reflector is circular or polygonal, and each panel is a curved member having three sides: one outer side, forming the outside edge of the heat reflector, and two inner sides, corresponding to radii of the heat reflector. If the heat reflector is circular, each outer side is curved. When fully set-up, each inner side mates with a inner side of a neighboring panel to connect the panels, possibly by overlapping and forming a lap joint. Each inner side of a heat reflector panel includes, for example, a set of attachment points, such as screw holes or friction fit points. One inner side of each heat reflector panel may include a raised portion acting as a stop and defining the limit of the distance which two attachment points may slide over each other.

Each panel also may include a shaped or cutout portion at the area where the two downward extensions join, so that when the heat reflector is set up a mounting hole is formed near the center of the up heat reflector. Using such a mounting hole, the set-up heat reflector may be mounted on the heater. A disk may be mounted over this mounting hole to further enable mounting to the heater. The disk may be mounted to the panels using, for example, screws, nuts and bolts, or by friction fit. When the heat reflector is disassembled, each panel may stack on top of one another; in such a manner the heat reflector takes up little storage space.

Figure 6A:
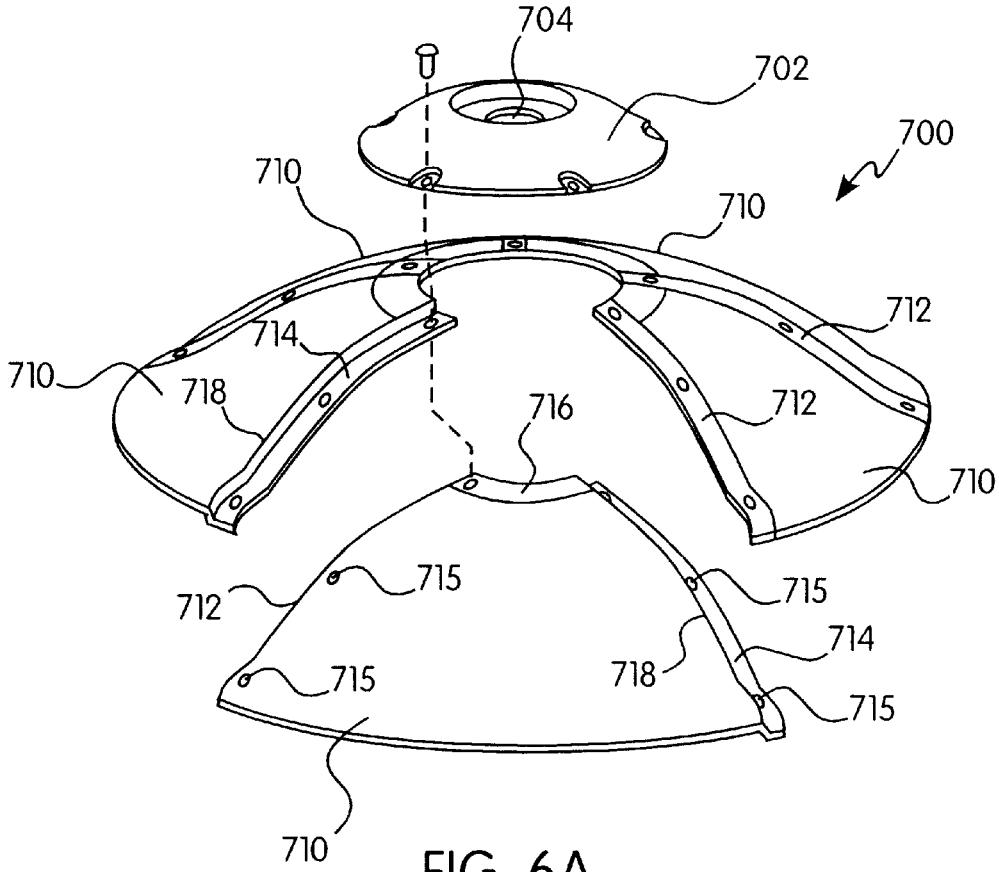
FIG. 6*a* illustrates a heat reflector of a heater according to another embodiment of the present invention.

FIG. 6*a* illustrates a heat reflector of a heater according to another embodiment of the present invention. Referring to FIG. 6*a,* the heat reflector 700 includes five panels 710 and a center disk 702. Other numbers of panels may be used, if desired. The center disk 702 mounts to the panels 710 via, for example, screws, nuts and bolts or rivets. Each panel 710 includes inner portions 712 and 714, each inner portion 712 and 714 having screw holes 715. One inner portion 714 of each panel 710 includes a lip 718. Each panel 710 includes a shaped or cutout portion 716; when the heat reflector is fully set-up the cutout portion 716 defines a mounting hole at which a center disk 702 may be mounted. The center disk 702 includes a mounting hole 704 which can be used for mounting on a heater. Preferably, each panel 710 is thin gauge steel, and preferably the center disk 702 is constructed of metal such as aluminum or steel and is thicker than the panels 710. In alternate embodiments, other suitable materials may be used.

Figure 6B:
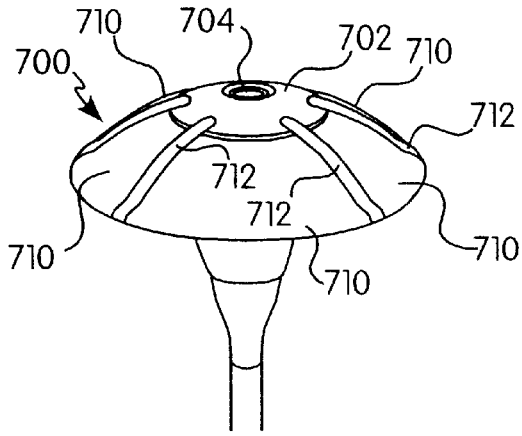
FIG. 6*b* illustrates the heat reflector of FIG. 6*a,* mounted to a heater.

To set-up the panels 710 into the heat reflector 700, the inner portions 712 and 714 of each adjacent panel 710 slide over each other and are connected by, for example, screws, nuts and bolts or rivets. Each lip 718 is preferably a raised ridge or extension and acts as a stop to define the limit by which the panels 710 may slide over each other. FIG. 6*b* illustrates the heat reflector of FIG. 6*a,* mounted to a heater. When set-up, the heat reflector 700 may be mounted to a heater by fitting the hole 704 over an extension on the top of the heater; the extension may attach to the heat reflector 700 by friction fit, by being screwed on, or by other methods.

In a further embodiment, the heat reflector is formed from of a set of panels surrounded by and connected by a frame, each panel forming a section of the heat reflector. In such an embodiment, the heat reflector may be, for example, circular or polygonal, and each panel is a flat member. The frame is formed from a set of frame members, each having a slot for holding one or more panels. The frame members join together by, for example, screws, nuts and bolts or friction fit, to form the frame and to hold the panels. Preferably, when the frame and panels are joined, a mounting hole or open portion is formed near the center of the fully set-up heat reflector so that the heat reflector may be mounted on the heater. A disk may be mounted over this hole to further enable mounting to the heater; this disk may in turn include a mounting hole. When disassembled, the panels, frame members, and disk may be stacked and stored to take up less space than the fully set-up heat reflector.

Figure 7A:
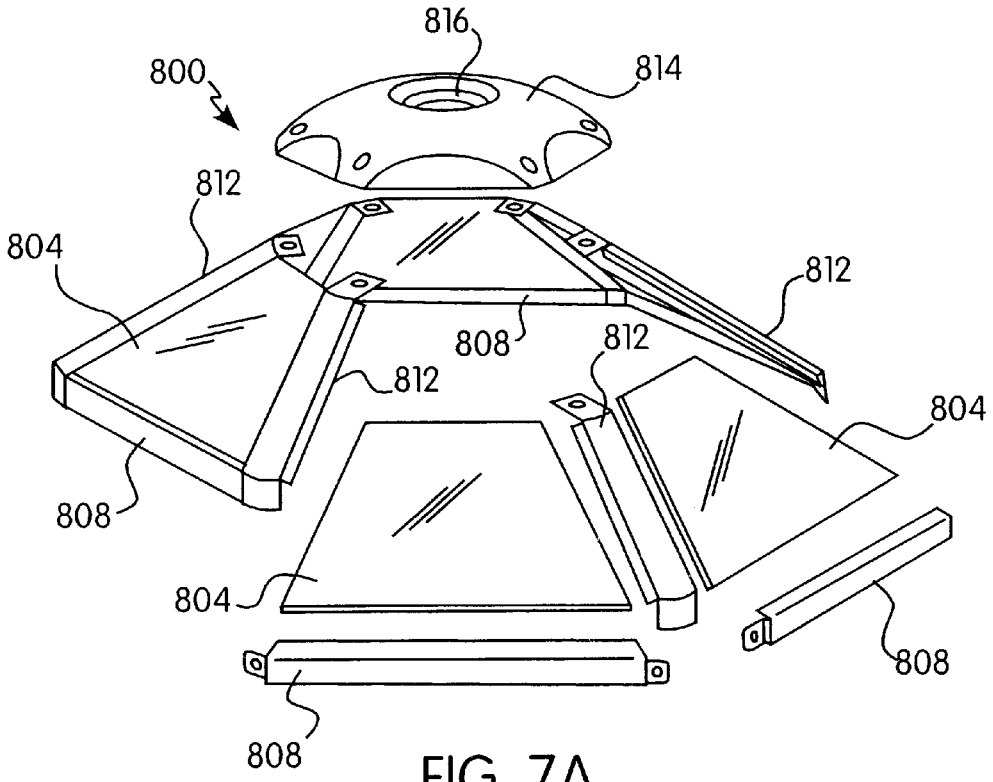
FIG. 7*a* illustrates a heat reflector of a heater according to another embodiment of the present invention, partially set-up.

FIG. 7*a* illustrates a heat reflector of a heater according to another embodiment of the present invention, partially set-up. Referring to FIG. 7*a,* the heat reflector 800 includes, for example, six panels 804, six outer frame members 808, six inner frame members 812, and a central mounting disk 814. Other numbers of panels and frame members may be used. The frame members 808 and 812 attach to each other and to the disk 814, preferably by screws or nuts and bolts. The frame members 808 and 812 and the disk 814 may attach by other methods, such as friction fit. Each outer frame member 808 includes a slot for holding one of the panels 804. Each inner frame member 812 includes two slots for holding two adjacent panels 804. The disk 814 includes an opening 816 for mounting to a heater.

Figure 7B:
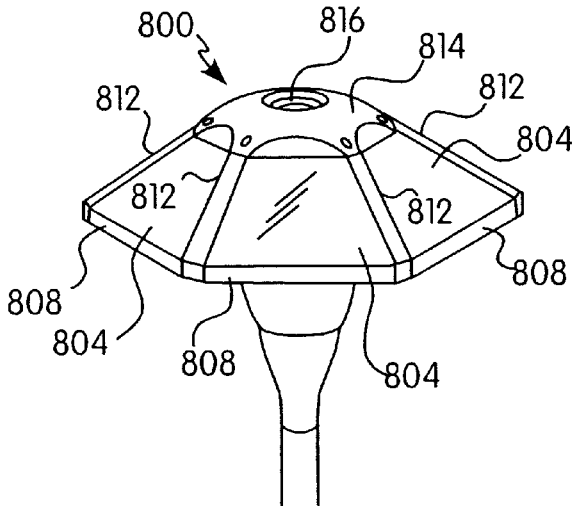
FIG. 7*b* illustrates the heat reflector of FIG. 7*a,* fully set-up and mounted to a heater.

Preferably, each panel 804 is manufactured from decorative, heat resistant glass and includes a reflective coating which faces the heating and lighting elements of the heater when the heat reflector is set-up and mounted to a heater. Preferably, each of the frame members 808 and 812 is formed from aluminum or steel, and preferably the disk 814 is steel. The elements of the heat reflector 800 may be formed from other suitable materials. FIG. 7*b* illustrates the heat reflector of FIG. 7*a,* fully set-up and mounted to a heater. When set-up, the heat reflector 800 may be mounted to a heater by fitting the opening 816 over an extension on the top of the heater; the extension may attach to the heat reflector 800 by friction fit, by being screwed on, or by other methods. The heat reflector 800 is preferably generally convex; if the panels 804 are flat the shape of the heat reflector 800 may come from the frame members 808 and 812.

In a further embodiment, the heat reflector includes a set of panels, where all the panels are connected at a single pivot point. The panels may rotate and slide with respect to each other at the pivot point. Preferably, each panel represents a portion of a circular disk or polygon. Each panel may be convex, so that the heat reflector may also be convex, or may be flat. When the panels are slid or rotated in a certain configuration the panels form the circular disk or polygon, and when the panels are slid or rotated in a second configuration the panels rest on top of one another to have the silhouette of the shape of one of the panels. Preferably, the pivot point is at the center of the disk or polygon. The disk or polygon may be joined to the top of a heater to form a heat reflector. The edges of each panel may include indentations, ridges or stamped detents to hold the panels in open and closed positions.

Figure 8A:
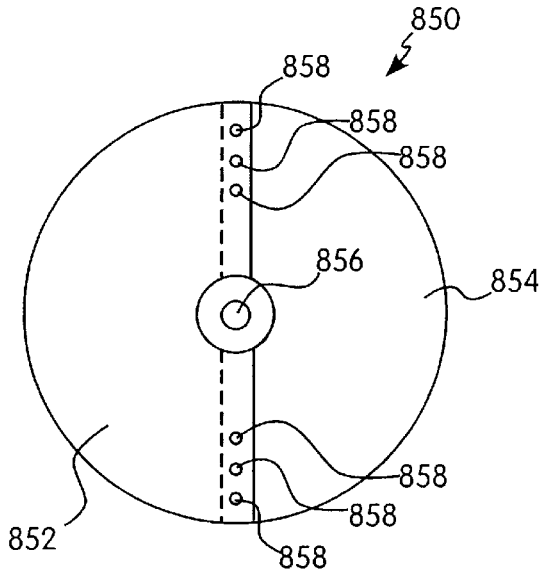
FIG. 8*a* illustrates a heat reflector of a heater according to another embodiment of the present invention, where the heat reflector is fully opened.

FIG. 8*a* illustrates a heat reflector of a heater according to another embodiment of the present invention, where the heat reflector is fully opened. Referring to FIG. 8*a,* the heat reflector 850 includes two panels 852 and 854, each forming slightly more than one half of a circle. Panels 852 and 854 are joined at a pivot point 856. Each panel 852 and 854 is preferably slightly convex. Each panel 852 and 854 may also include stamped indentations 858 at its inner edge. When the panels 852 and 854 are open, the stamped indentations 858 nest to hold the panels 852 and 854 in an open position, and when the panels 852 and 854 are closed, the stamped indentations 858 hold the panels 852 and 854 closed. Other methods may be used to hold the panels open; for example latches or ridges. Other numbers of panels may be used.

Figure 8C:
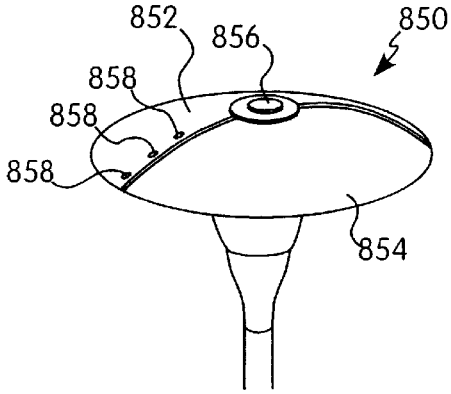
FIG. 8*c* illustrates the heat reflector of FIG. 8*a,* where the heat reflector is mounted to the heater.
Figure 8B:
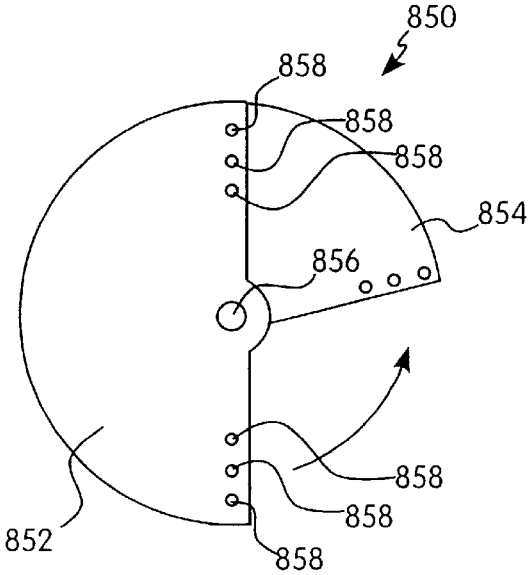
FIG. 8*b* illustrates the heat reflector of FIG. 8*a,* where the heat reflector is partially closed.

FIG. 8*b* illustrates the heat reflector of FIG. 8*a,* where the heat reflector is partially closed. Referring to FIG. 8*b,* the panel 852 can be seen sliding underneath the panel 854 to form a more compact heat reflector. FIG. 8*c* illustrates the heat reflector of FIG. 8*a,* where the heat reflector is mounted to the heater. When opened, the heat reflector 850 may be mounted to a heater by fitting a mounting hole in the heat reflector 850 over an extension on the top of the heater; the extension may attach to the heat reflector 850 by friction fit, by being screwed on, or by other methods.

In a further embodiment, the heat reflector includes a set of panels which fit together to form the entire heat reflector. Preferably, each panel represents a portion of a circular disk or polygon; for example, each panel may represent a strip of the heat shield. Each panel may be convex, so that the heat reflector may also be convex, or may be flat. The panels may connect to each other by, for example, snapping together or by screws. The disk or polygon may be joined to the top of a heater to form a heat reflector.

Figure 9A:
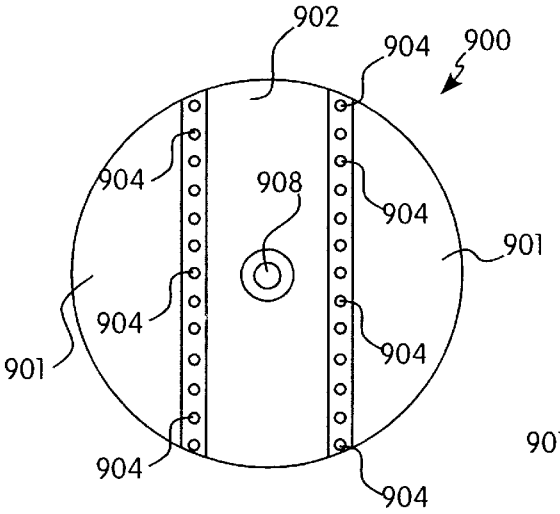
FIG. 9*a* illustrates a heat reflector of a heater according to another embodiment of the present invention, where the heat reflector is set-up.
Figure 9B:
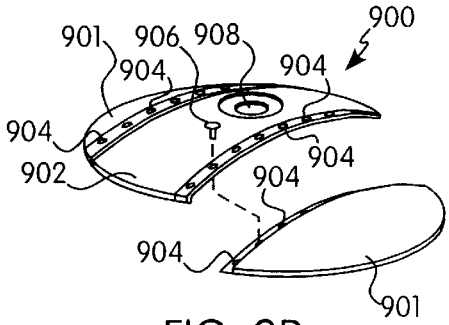
FIG. 9*b* illustrates the heat reflector of FIG. 9*a,* partially set-up.
Figure 9C:
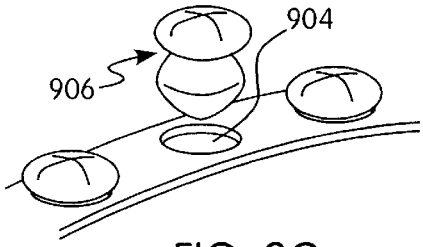
FIG. 9*c* illustrates the use of a snap connector of the heat reflector of FIG. 9*a.*
Figure 9D:
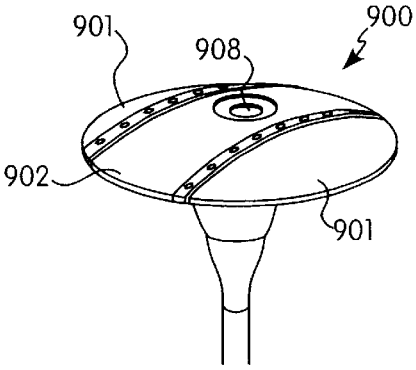
FIG. 9*d* illustrates the heat reflector of FIG. 9*a,* fully set-up and mounted to a heater.

FIG. 9*a* illustrates a heat reflector of a heater according to another embodiment of the present invention, where the heat reflector is assembled. Referring to FIG. 9*a,* the heat reflector 900 includes two edge panels 901 and one middle panel 902. Each panel 901 and 902 forms, for example, part of a circle, and is preferably shaped to be slightly convex. Each panel 901 and 902 includes snap holes 904 at the edge where it joins an adjacent panel 901 or 902. FIG. 9*b* illustrates the heat reflector of FIG. 9*a,* partially assembled. FIG. 9*c* illustrates the use of a snap connector of the heat reflector of FIG. 9*a.* Referring to FIGS. 9*b* and 9*c,* a set of snap connectors 906 enter the snap holes of the panels 901 and 902 to join adjacent panels 901 and 902. Other types of connectors or connecting methods may be used; for example, screws or bolts. When assembled, the heat reflector 900 may be mounted to a heater at a mounting hole 908 located in the center panel 902. The heater may include an extension on the top of the heater; the extension may attach to the heat reflector 900 by friction fit, by being screwed on, or by other methods. FIG. 9*d* illustrates the heat reflector of FIG. 9*a,* fully assembled and mounted to a heater.

In a further embodiment, the heat reflector includes a set of fins hinged to a set of connectors. The connectors are arranged, for example, in a circle or polygon, and the fins extend out radially. When the heat reflector is in its un-set-up, compressed form, the connectors open to cause the fins to compress and line up in a generally parallel orientation. To open the reflector to its full size, the connectors close and form a ring, forcing the fins to spread and form the circle or polygon of the heat shield. The fin s may pivot with respect to the connectors. Each connector may include a rib fixed to the connector for aiding in spreading and compressing fins, and to add structural support. The fins may have catches or raised portions to limit the extent to which they may spread and to prevent gaps or holes from forming in the fully opened heat reflector. The fins may be curved or bent so that the heat reflector has a concave shape.

Figure 10A:
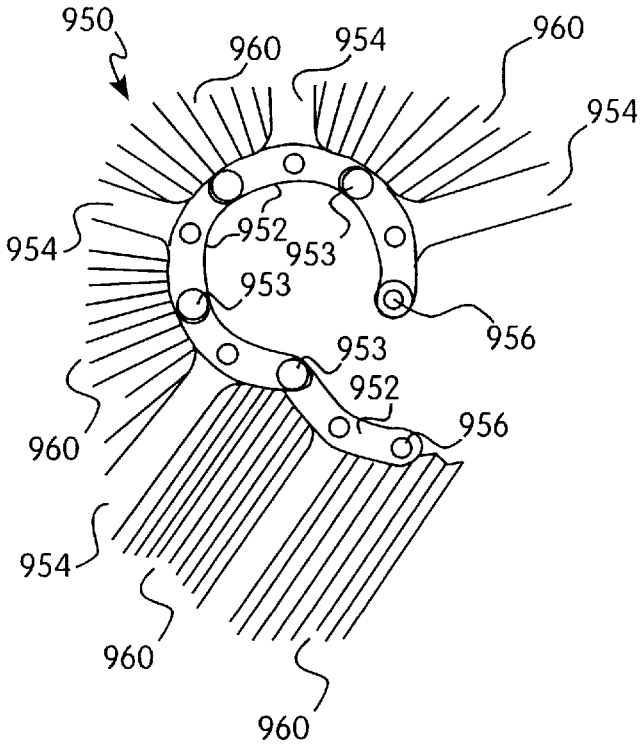
FIG. 10*a* illustrates a portion of a heat reflector of a heater according to another embodiment of the present invention.
Figure 10E:
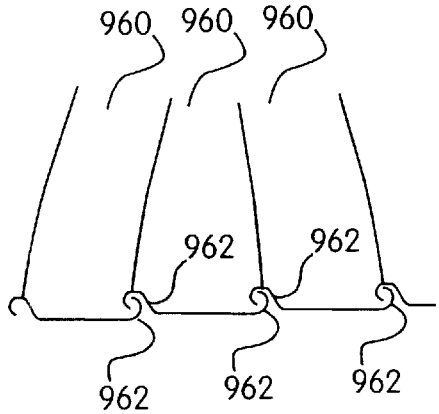
FIG. 10*e* depicts a portion of the fins of the heat reflector of FIG. 10*a.*

FIG. 10*a* illustrates a portion of a heat reflector of a heater according to another embodiment of the present invention. Referring to FIG. 10*a,* the heat reflector 950 includes a set of base connectors 952, each connector including a fixed rib 954 extending from the connector. When the heat reflector 950 is fully set up each rib 954 extends in a preferably radial direction. The connectors 952 may be straight, or may be curved so that the plurality of connectors 952 may form a circle; the connectors 952 may be other shapes. Preferably, each connector 952 is pivotably connected to an adjacent connector 952 by a set of pivot points 953; the pivot points may be, for example, rivets. Two end connectors of the connectors 952 may disconnect from each other at a detachable link such as hingeable snap point 956. Thus the connectors 952 may be joined together to form a circle or polygon, and may be opened to form a line of linked connectors 952 as shown in FIG. 10*b.*

A set of fins 960 is pivotably attached to each connector 952. As shown in FIG. 10*b,* two fins 960 on each connector are connected to each side of a rib 954. When the connectors 952 are joined to open and form the heat shield 950, the ribs 954 spread and thus cause the fins 960 to spread out. FIG. 10*e* depicts a portion of the fins of the heat reflector of FIG. 10*a.* Preferably, each fin 960 includes two raised portions or catches 962 which catch on the catches 962 or adjacent fins 960 to control the extent to which the fins 960 may spread. Each fin 960 preferably also preferably increases in width towards the end furthest from its mounting point to a connector 952. FIG. 10*b* illustrates the heat reflector of FIG. 10*a* folded for storage.

Figure 10C:
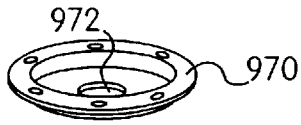
FIG. 10*c* illustrates the center hub of the heat reflector of FIG. 10*a.*
Figure 10B:
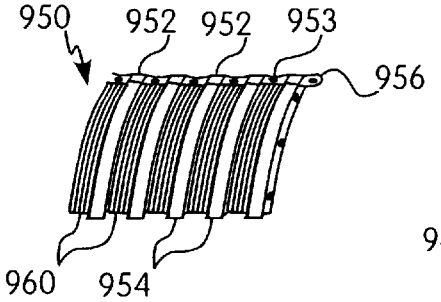
FIG. 10*b* illustrates the heat reflector of FIG. 10*a,* folded for storage.
Figure 10D:
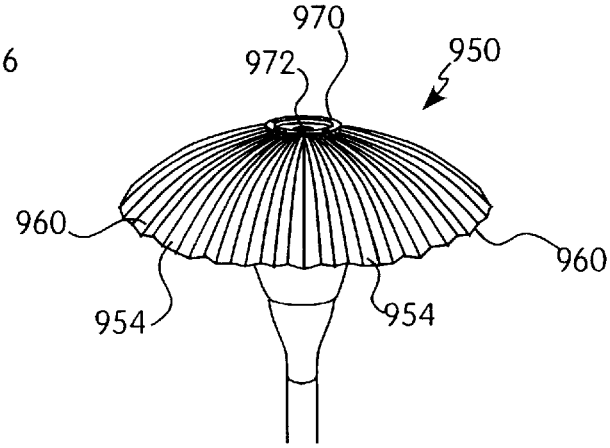
FIG. 10*d* illustrates the heat reflector of FIG. 10*a,* mounted to a heater.

FIG. 10*c* illustrates the center hub of the heat reflector of FIG. 10*a.* Preferably, the heat reflector 950 includes a center hub 970 which attaches to the connectors 952 when the connectors 952 close to form a polygon or circle. The center hub 970 may connect to the connectors 952 via screws, bolts, or other methods. The center hub 970 includes a mounting hole 972, by which the heat reflector may be attached to a heater. FIG. 10*d* illustrates the heat reflector of FIG. 10*a,* mounted to a heater. When assembled, the heat reflector 950 may be mounted to a heater by fitting the hole 972 over an extension on the top of the heater; the extension may attach to the heat reflector 950 by friction fit, by being screwed on, or by other methods. The connectors 952 may be, for example, stainless steel, and the fins may be, for example, pleated metal foil or heat resistant fabric.

While the heater of the present invention is described with respect to specific embodiments, it should be noted that the present invention may be implemented in different manners and used with different applications. The heater according to an embodiment of the present invention may be of a different configuration and may contain different components. For example, no regulator may be included or an alternate ignition system may be utilized. The heater may include a light and a heating apparatus but not include a collapsible or compact heat reflector. Furthermore, the heater may lack a light but include a collapsible or compact heat reflector. While the heater is described as being fueled by flammable gas, the heating apparatus and/or the light may be powered in other ways, such as by liquid fuel or electricity.

What is claimed is:

1. An apparatus for providing heat and light comprising:

a first burner;

a second burner disposed below the first burner;

a mantle attached to the second burner and producing light when heated;

a fuel delivery system providing fuel and air to the first burner and to the second burner; and a set of air exhaust openings disposed below the first burner, wherein exhaust from the second burner may exit the apparatus from the air exhaust openings;

wherein the first and second burners can be operated simultaneously.

2. The apparatus of claim 1 comprising a set of air intake openings located below the second burner.

3. The apparatus of claim 1 comprising an outer shell surrounding the second burner, wherein the set of air exhaust openings include a plurality of scalloped openings disposed on the outer shell.

4. The apparatus of claim 1 comprising a heat shield disposed between the first burner and the second burner.

5. The apparatus of claim 1 wherein the fuel delivery system includes at least:

a first adjustable valve providing a controlled fuel flow to the first burner; and a second adjustable valve providing a controlled fuel flow to the second burner.

6. The apparatus of claim 1 comprising a heat reflector disposed above the first burner, wherein the heat reflector may be removed from the apparatus and compacted.

7. The apparatus of claim 1 comprising a mesh disposed adjacent to the first burner, wherein heating of the mesh by the first burner provides radiant heat.

8. An apparatus for providing heat and light comprising:

a first burner;

a second burner;

a mantle attached to the second burner and producing light when heated;

a set of removable glass panels disposed around the second burner; and a fuel delivery system providing fuel and air to the first burner and to the second burner;

wherein the first and second burners can be operated simultaneously.

9. The apparatus of claim 8 comprising a shell surrounding the second burner, wherein each glass panel is secured to the shell using a manually operable fastener.

10. The apparatus of claim 8 comprising a shell surrounding the second burner, the shell including a set of openings, each opening having a lower edge, wherein each glass panel includes a set of tabs and, when attached to the apparatus, rests on a corresponding lower edge.

11. The apparatus of claim 10 wherein the shell includes a set of tab supports, wherein each glass panel tab is held in place by a corresponding tab support.

12. The apparatus of claim 11 wherein each glass panel includes a frame supporting a glass member, wherein the tabs extend from the frame.

13. The apparatus of claim 8 comprising a set of air exhaust openings disposed below the first burner allowing exhaust from the second burner to exit the apparatus.

14. The apparatus of claim 8 wherein the fuel delivery system comprises:

a first adjustable valve providing a controlled fuel flow to the first burner; and a second adjustable valve providing a controlled fuel flow to the second burner.

15. The apparatus of claim 8 comprising a heat reflector disposed above the first burner, wherein the heat reflector may be removed from the apparatus and compacted.

16. The apparatus of claim 8 comprising a mesh disposed adjacent to the first burner, wherein heating of the mesh by the first burner provides radiant heat.

* * * * *